US007640703B2

(12) United States Patent
Freyman et al.

(10) Patent No.: US 7,640,703 B2
(45) Date of Patent: Jan. 5, 2010

(54) DEMOUNTABLE AND REUSABLE CANOPY

(76) Inventors: David Freyman, 401 SW. Duval Ave., Port St. Lucie, FL (US) 34983; Lee M. Walker, 6569 Timber La., Boca Raton, FL (US) 33433; Celestin Xavier Pierre, 304 N. Broughton Sq., Boynton Beach, FL (US) 33436

( * ) Notice: Subject to any disclaimer, the term of this patent is extended or adjusted under 35 U.S.C. 154(b) by 80 days.

(21) Appl. No.: 11/852,420

(22) Filed: Sep. 10, 2007

(65) Prior Publication Data

US 2009/0065038 A1 Mar. 12, 2009

(51) Int. Cl.

| | |
|---|---|
| ***E04H 15/34*** | (2006.01) |
| ***E04H 15/58*** | (2006.01) |
| ***E04C 2/38*** | (2006.01) |
| ***E02D 27/00*** | (2006.01) |
| *E02D 5/22* | (2006.01) |
| *E04H 6/00* | (2006.01) |
| *E04H 12/00* | (2006.01) |

(52) U.S. Cl. ..... 52/298; 52/74; 52/297; 52/79.6; 52/653.2; 135/121; 135/117; 405/231

(58) Field of Classification Search ..... 52/73, 52/74, 298, 96, 297, 79.6, 78, 656.9, 656.2, 52/653.1, 653.2, 655.12; 135/87, 115, 116, 135/117, 121, 127, 128, 129; 403/231; 248/530, 248/533, 156; 405/231, 232, 233, 250, 251, 405/244, 229

See application file for complete search history.

(56) References Cited

U.S. PATENT DOCUMENTS

| | | | | |
|---|---|---|---|---|
| 1,804,320 A | | 5/1931 | Cross | |
| 1,965,639 A | * | 7/1934 | Glass | 248/353 |
| 2,164,108 A | | 6/1939 | Greulich | |
| 2,679,911 A | * | 6/1954 | Bhend | 52/298 |
| 2,855,021 A | | 10/1958 | Hoppe | |
| 2,928,405 A | * | 3/1960 | Lawson | 135/95 |
| 3,000,146 A | * | 9/1961 | Rogers | 52/704 |
| 3,495,371 A | * | 2/1970 | Mitchell, Jr. | 52/653.1 |
| 3,506,243 A | * | 4/1970 | Seiler | 256/59 |
| 3,798,863 A | * | 3/1974 | Latson | 52/204.597 |
| 3,808,757 A | * | 5/1974 | Greenwood | 52/184 |
| 3,908,327 A | | 9/1975 | Quigg | |
| 4,019,301 A | | 4/1977 | Fox | |
| D279,608 S | | 7/1985 | Carey | |
| 4,576,502 A | * | 3/1986 | Bancroft | 403/231 |
| 4,606,167 A | | 8/1986 | Thorne | |
| 4,641,676 A | * | 2/1987 | Lynch | 135/145 |
| 4,683,019 A | | 7/1987 | Motoki | |

(Continued)

FOREIGN PATENT DOCUMENTS

JP 2004100153 A 4/2004

*Primary Examiner*—Robert J Canfield
*Assistant Examiner*—Babajide Demuren
(74) *Attorney, Agent, or Firm*—GrayRobinson, P.A.

(57) ABSTRACT

A demountable and reusable canopy is provided comprising a number of vertical supports, located along an area to be covered, each including a footer which mounts an insert tube below the finish grade of the ground and a post having a hollow interior shaped to receive an exposed portion of the insert tube. A beam is secured to the vertical supports by self-tapping screws which extend into screw cases formed in the posts, and adjacent beams mount decking sections to form the completed canopy.

29 Claims, 9 Drawing Sheets

U.S. PATENT DOCUMENTS

| | | | | |
|---|---|---|---|---|
| 4,815,713 | A | 3/1989 | Schmanski | |
| 4,930,270 | A * | 6/1990 | Bevacqua | 52/126.1 |
| 4,961,258 | A | 10/1990 | Menzel | |
| 4,976,084 | A | 12/1990 | Verbiar et al. | |
| 5,323,583 | A | 6/1994 | Venegas, Jr. | |
| D380,274 | S | 6/1997 | Stamets | |
| 5,913,778 | A * | 6/1999 | Hying et al. | 52/40 |
| 6,061,991 | A | 5/2000 | Dahl | |
| 6,389,760 | B1 * | 5/2002 | McDonnell | 52/165 |
| 6,505,454 | B2 | 1/2003 | Dingler | |
| 6,651,685 | B2 * | 11/2003 | Connelly et al. | 135/117 |
| 6,668,495 | B1 | 12/2003 | Prince | |
| 6,874,766 | B2 * | 4/2005 | Curatolo | 256/59 |
| 7,341,070 | B1 * | 3/2008 | Wallace | 135/117 |
| 2002/0056251 | A1 | 5/2002 | Venegas, Jr. | |
| 2003/0167701 | A1 * | 9/2003 | Rich | 52/79.6 |
| 2004/0194420 | A1 | 10/2004 | Venegas, Jr. | |
| 2006/0032184 | A1 | 2/2006 | Almeter | |

* cited by examiner

DEMOUNTABLE AND REUSABLE CANOPY

FIELD OF THE INVENTION

This invention relates to canopies, and, more particularly, to a demountable and reusable canopy which may be installed over an area to be protected from the weather, disassembled without leaving any portion of the canopy exposed above the grade level of the ground and then reassembled, if desired, at a later time.

BACKGROUND OF THE INVENTION

Canopies are commonly employed to protect individuals, equipment, vehicles, furniture and other items from rain and other elements. Depending on the area to be protected, canopies can take the form of a covered walkway, a storage shed, a pavilion, a carport, a patio enclosure and a variety of other units for covering a particular area. For example, covered walkways are frequently employed to protect individuals from rain and the like while walking in between buildings or from a parking lot into a building and the like. Sidewalks connecting different buildings on the campus of schools may be protected by covered walkways so that the children can move from class-to-class during the school day while being shielded from the rain. Storage sheds, carports, patio enclosures and similar units with a roof but no side walls are commonly use to afford protection of equipment, vehicles, furniture and other items from rain, leaves, falling branches and the like.

Historically, canopies in the form of a covered walkway comprise a number of pairs of vertical posts wherein one post of each pair is located on one side of a sidewalk or other area to be covered and the other post in such pair is positioned in alignment with the first post on the opposite side of the sidewalk. Adjacent pairs of posts are spaced from one another in the direction the sidewalk extends. One end of each post is embedded in a concrete footer located in the ground in position along the side of the sidewalk. Once the posts are mounted to a concrete footer, they are permanently in place and cannot be moved without digging up the footers which is a time consuming, difficult and expensive proposition. Consequently, once a covered walkway of this type is in place it usually remains there unless damaged and can create an obstruction to the movement of equipment, materials and the like through the area occupied by the walkway.

The posts extend upwardly from the footers to the desired height of the walkway. A beam spans each pair of posts in a direction transverse to the walkway, and decking is attached to adjacent beams to form the "roof" of the walkway. Typically, each end of the beam is welded to one of the posts it spans. One method currently in use is to weld a bolt plate on the inside of each post and mechanically connect the beam to such bolt plate by fasteners, e.g. bolts, self-tapping screws or the like. Alternatively, a bent or angle is welded to both the post and beam to secure them together. The beams and posts of covered walkways are usually formed of extruded aluminum which is light weight, weather resistant and relatively strong. However, one issue with aluminum is that it is weakened when exposed to the heat required for welding. As such, the connections between the beam and posts in prior designs negatively affects the strength and durability of the walkway.

The same general construction described above is also employed for canopies in the form of pavilions, storage sheds, carports, patio enclosures and the like, except that the posts may not be arranged in pairs. Depending on the size and shape of the area to be covered, and/or the presence of obstructions in or around such area, the posts may be staggered from one another or otherwise arranged in some other non-uniform pattern rather than in pairs. The beams are fitted onto the posts, and the decking is mounted to the beams, in the same manner noted above. Nevertheless, and regardless of whether the canopy forms a covered walkway or other type of enclosure, all known canopies suffer from the problems described above, e.g. the posts remain permanently in place above ground thus preventing the canopy from being taken apart and reused, and, the aluminum forming the posts and beams is weakened as a result of welds at the connection points between the posts and beams.

The inability for canopies employed in the prior art to be reused is of great concern to a variety of potential customers such as school systems, companies, municipalities and the like. In many instances a canopy is needed for a one-time event, for an event that is held periodically, for temporary storage or for other situations wherein it is desirable to remove the canopy after it is used and then reuse the canopy for the same purpose or a different purpose at a later date. Canopies employing posts which are embedded within buried footers and remain permanently in place cannot accommodate such needs, and, as a result, are not cost effective for many potential customers. There is therefore a need for a more versatile canopy, which also eliminates weakening of the connection point between beams and posts due to welding.

SUMMARY OF THE INVENTION

This invention is directed to a canopy which is demountable and reusable in the sense that it may be assembled, disassembled except for a portion of the canopy which remains underground below finish grade, and then reassembled, if desired, at a later time.

In the presently preferred embodiment, a number of vertical supports are provided and arranged according to the size and shape of the area to be covered. Each vertical support comprises an insert tube secured within a footer placed in the ground, and a post having a hollow interior which receives an exposed portion of the insert tube. The insert tube and post of each vertical support are connected together by fasteners such as bolts.

The posts are provided with a number of screw cases or bosses which extend along their entire length. The screw cases add rigidity to the posts, and provide structure for mounting a beam at the top of the posts thus eliminating the need for welding an angle or a bolt plate to the post and/or beam. This feature of the present invention avoids weakening of the aluminum which forms the posts and beams, in contrast to prior art designs. Decking sections are secured to the beams in between adjacent vertical supports to complete the canopy.

Unlike prior designs, the construction of the canopy of this invention permits it to be assembled, disassembled and then reassembled at a later time. The insert tube of each vertical support is preferably located below the finish grade of the ground and remains permanently in place. If the canopy must be disassembled for any reason, the decking sections and beams are taken apart and removed from the posts, and the posts are disconnected from the insert tubes. Earth is then placed over the insert tubes to cover them up, level with the finish grade of the surrounding ground. In the event it is desired to reconstruct the canopy, the insert tubes are uncovered and reconnected to the posts in the same manner as the original canopy.

The construction of the canopy of this invention allows it to be employed by customers for a recurring use, or a different use, without creating a permanent obstruction of posts protruding from the ground as in prior art canopies. As noted above, the insert tube portion of each vertical support remains below ground when the canopy is disassembled. The canopy may be reassembled at that location by uncovering the insert tubes, or, alternatively, the posts, beams and decking of the canopy may be assembled with new footers and insert tubes at a different location, for the same type of application or a totally different one, at a later date. This multiple use feature of the present invention is highly desirable and a distinct improvement over existing designs.

BRIEF DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 3:
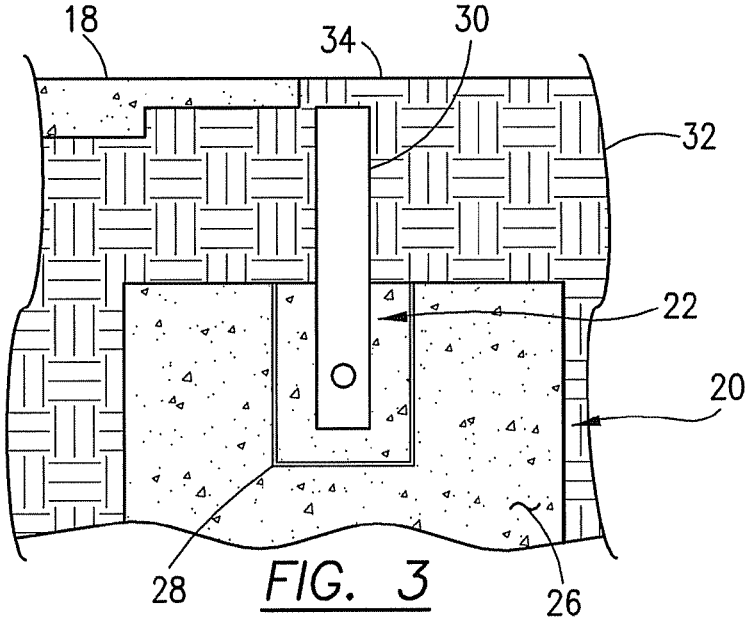
FIG. 3 is a cross sectional view of a portion of the lower end of one vertical support with the post removed from the insert tube.
Figure 4:
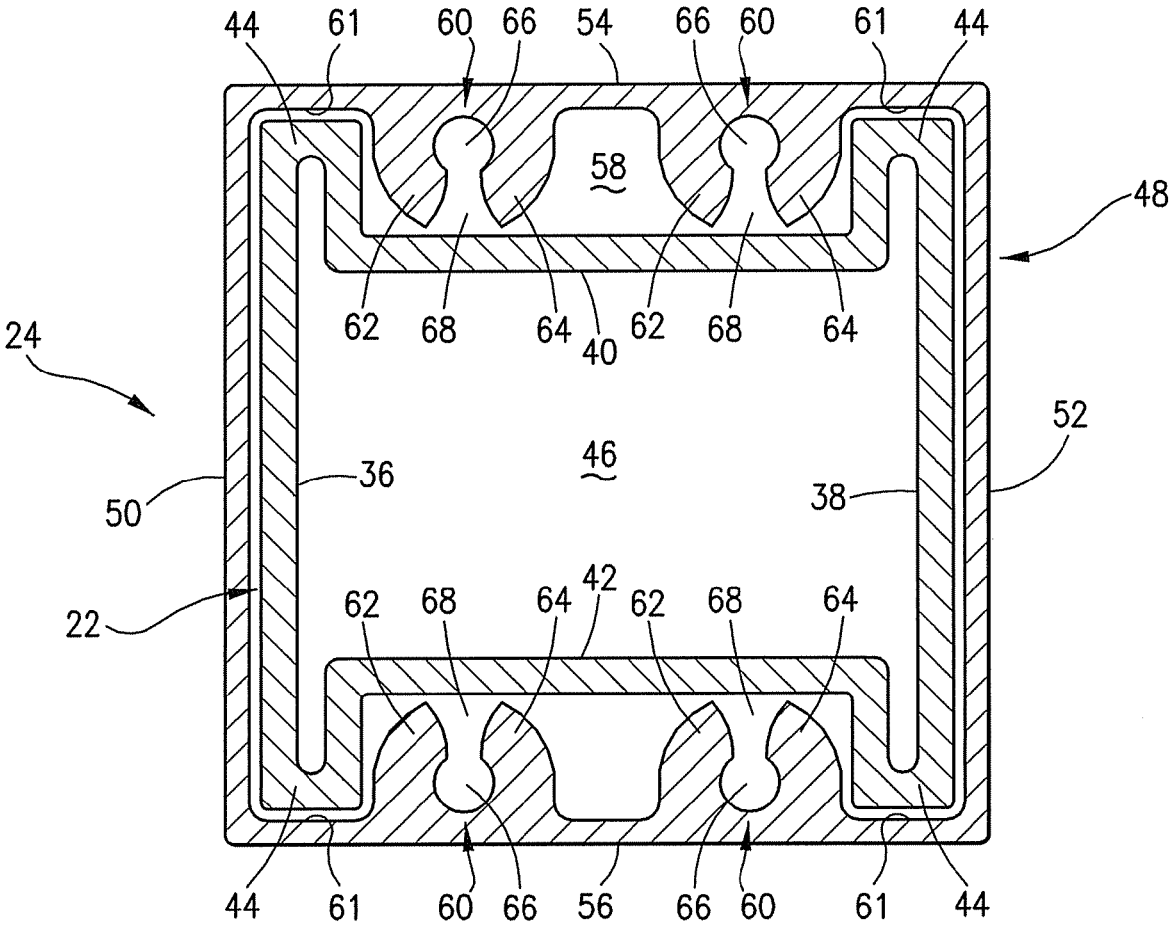
FIG. 4 is a cross sectional view, taken generally along line 4-4 of FIG. 2, of an assembled post and insert tube of a vertical support herein.
Figure 5:
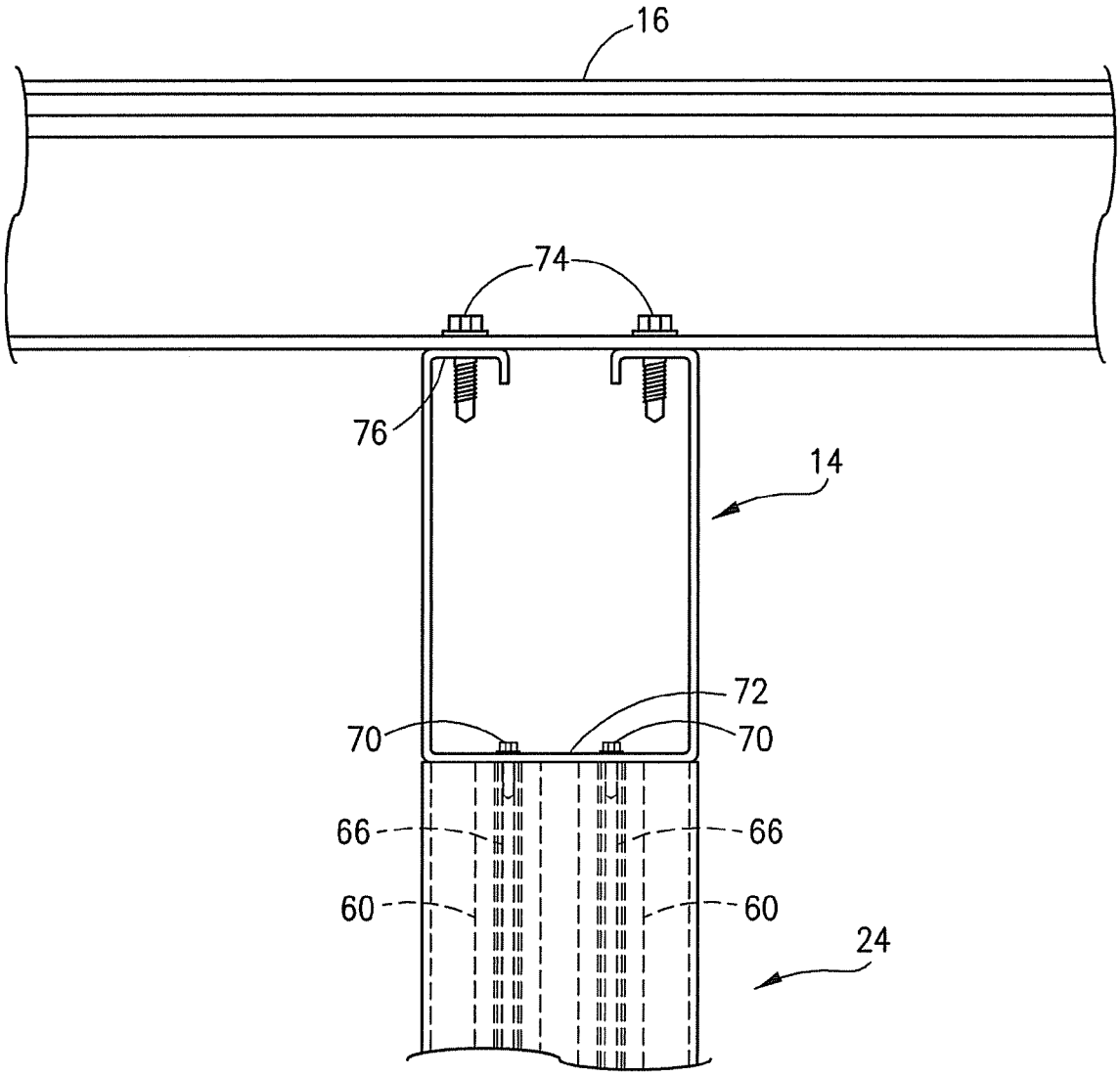
FIG. 5 is partial side view of the walkway illustrating the connections between the beam and post, and between the decking section and beam.
Figure 6:
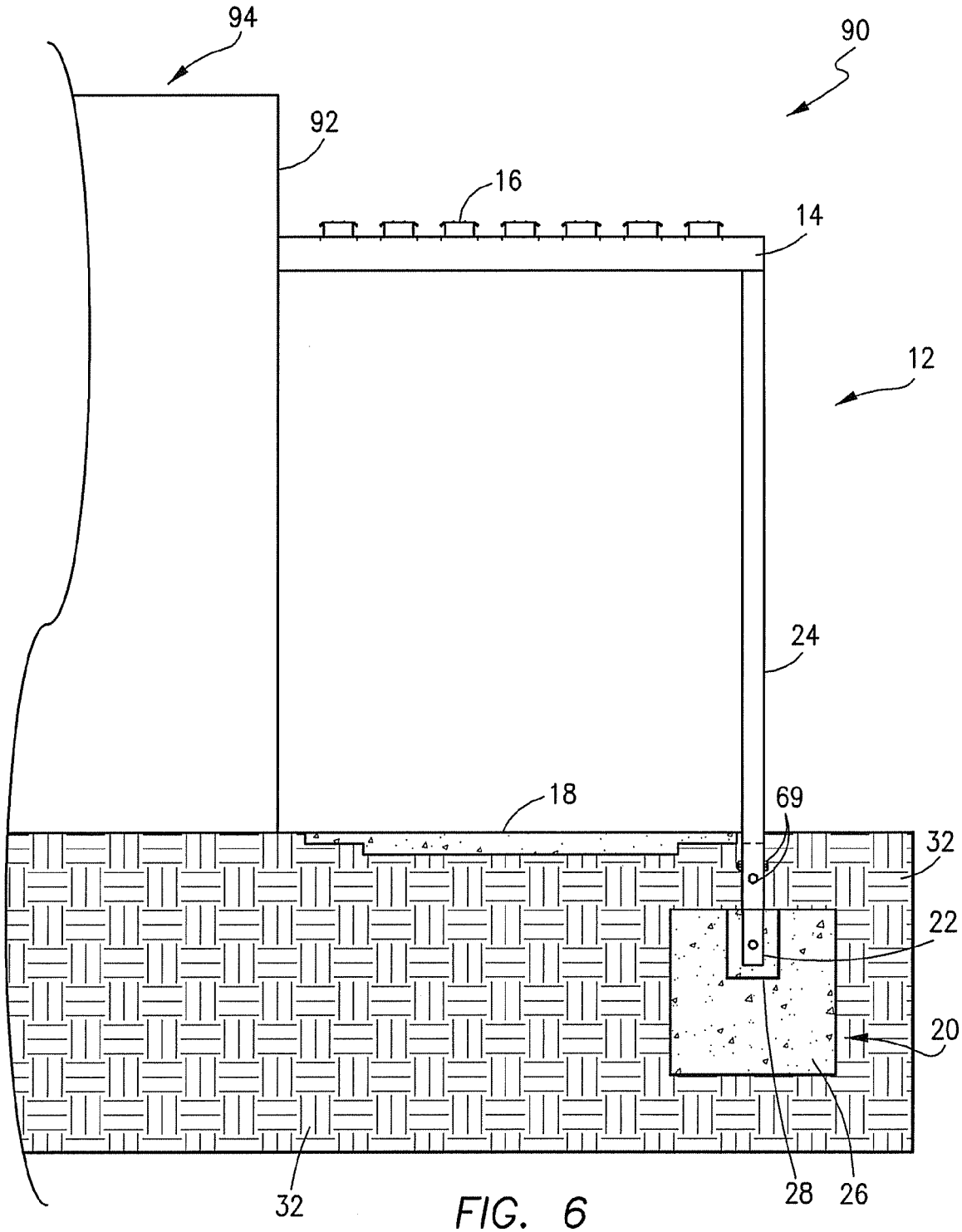
FIG. 6 is a view similar to FIG. 2 except depicting the canopy mounted along one side of a building or similar structure.
Figure 7:
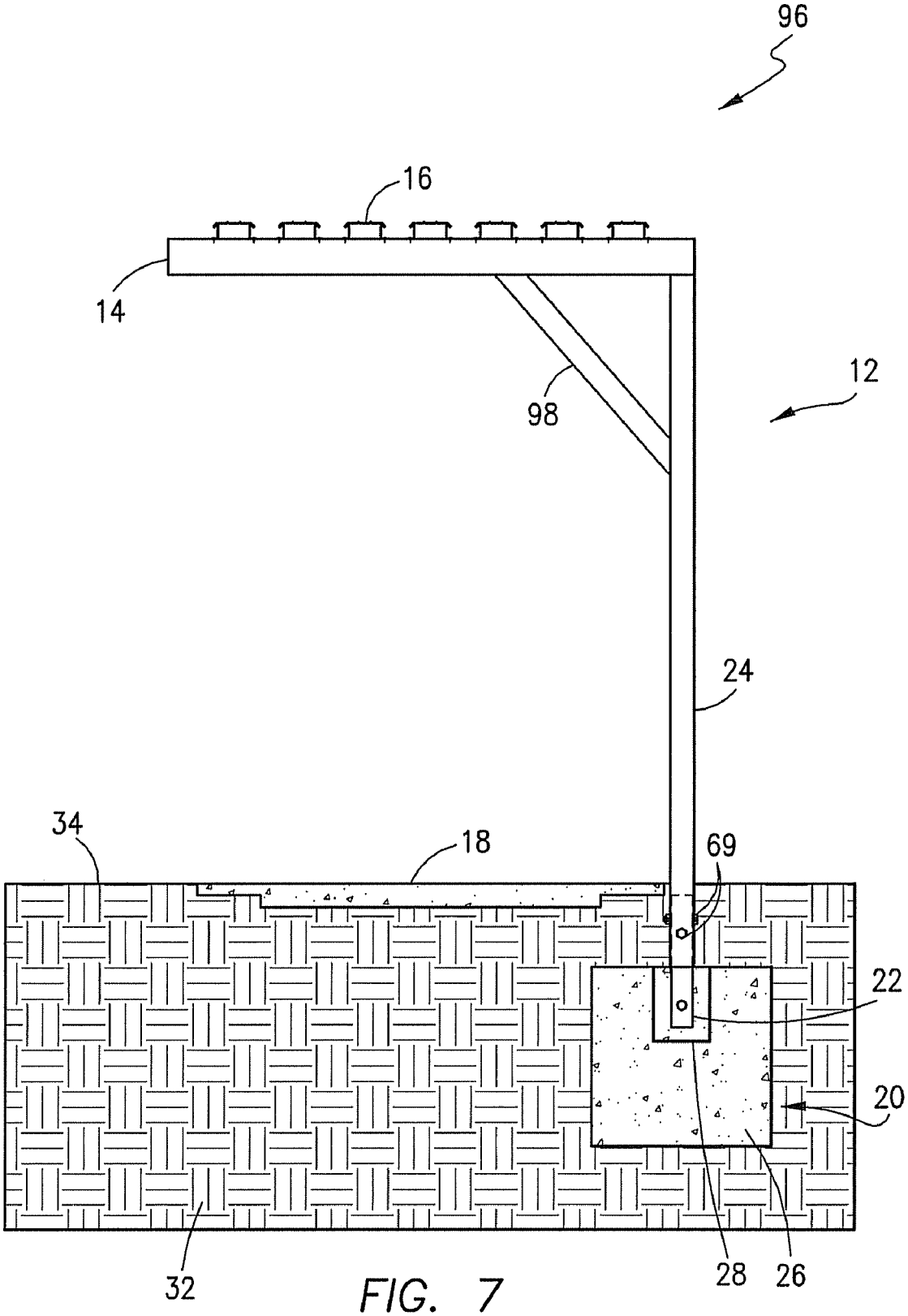
FIG. 7 is a view similar to FIG. 2 except illustrating a cantilevered construction of the canopy.
Figure 8:
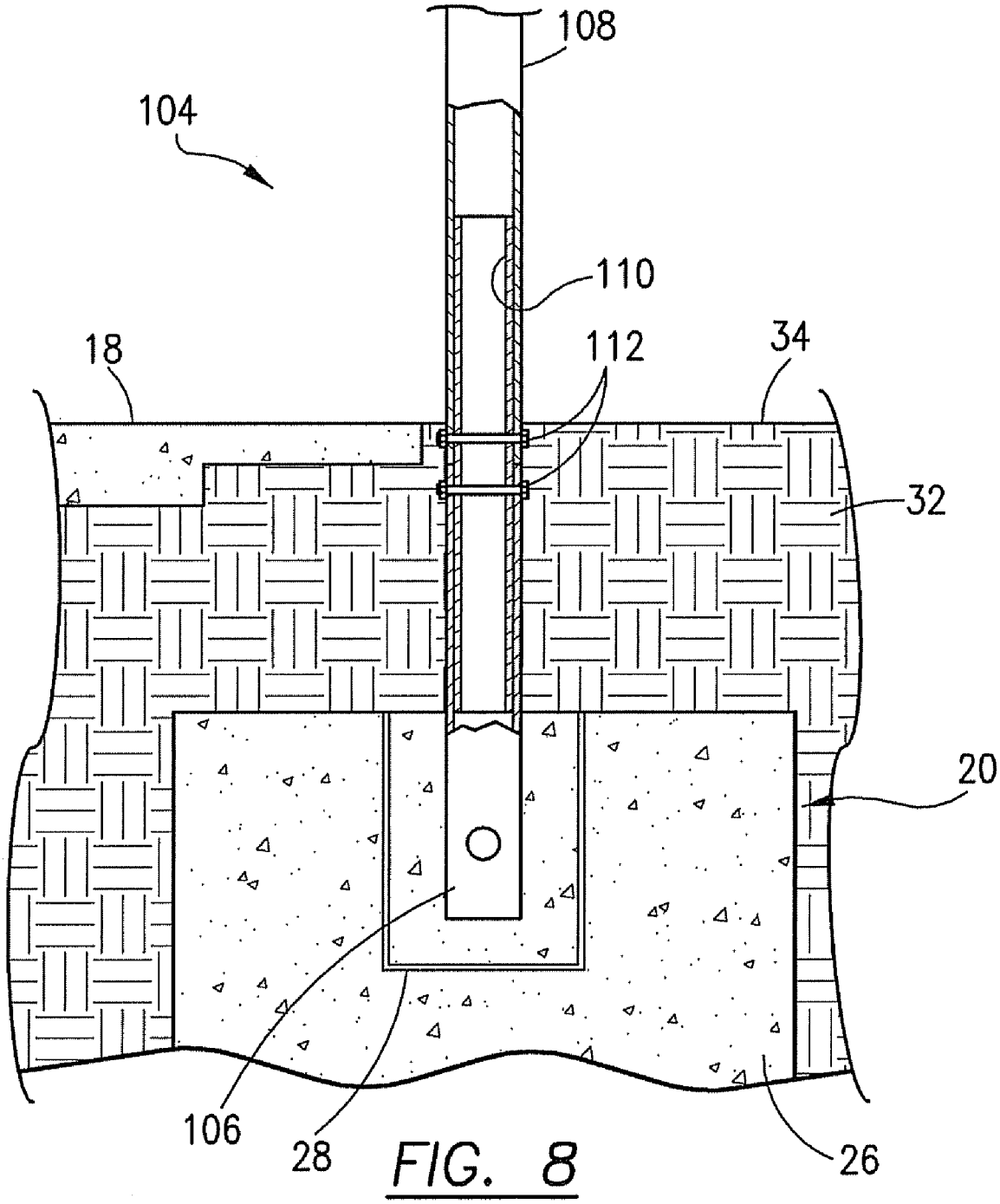
FIG. 8 is a view similar to FIG. 3 showing an alternative embodiment of connecting an insert tube and post.

Referring now to the Figs., alternative embodiments of canopies according to the teachings of this invention are illustrated. FIGS. 1 and 2, 6, 7 and 9 depict canopies in the form of a covered walkway, whereas FIG. 10 is intended to demonstrate that the canopy of this invention may be employed to cover an area of essentially any size and shape for applications such as storage sheds, pavilions, carports, patio enclosures and the like. Structural elements which are common to all embodiments are shown in FIGS. 3-5. FIG. 8 illustrates an alternative means of connecting vertical elements of the canopy herein, as described in detail below. For purposes of the present discussion, the terms "vertical," "top," "bottom" and the like used in the following description refer to the orientation of the canopies depicted in the Figs.

Figure 1:
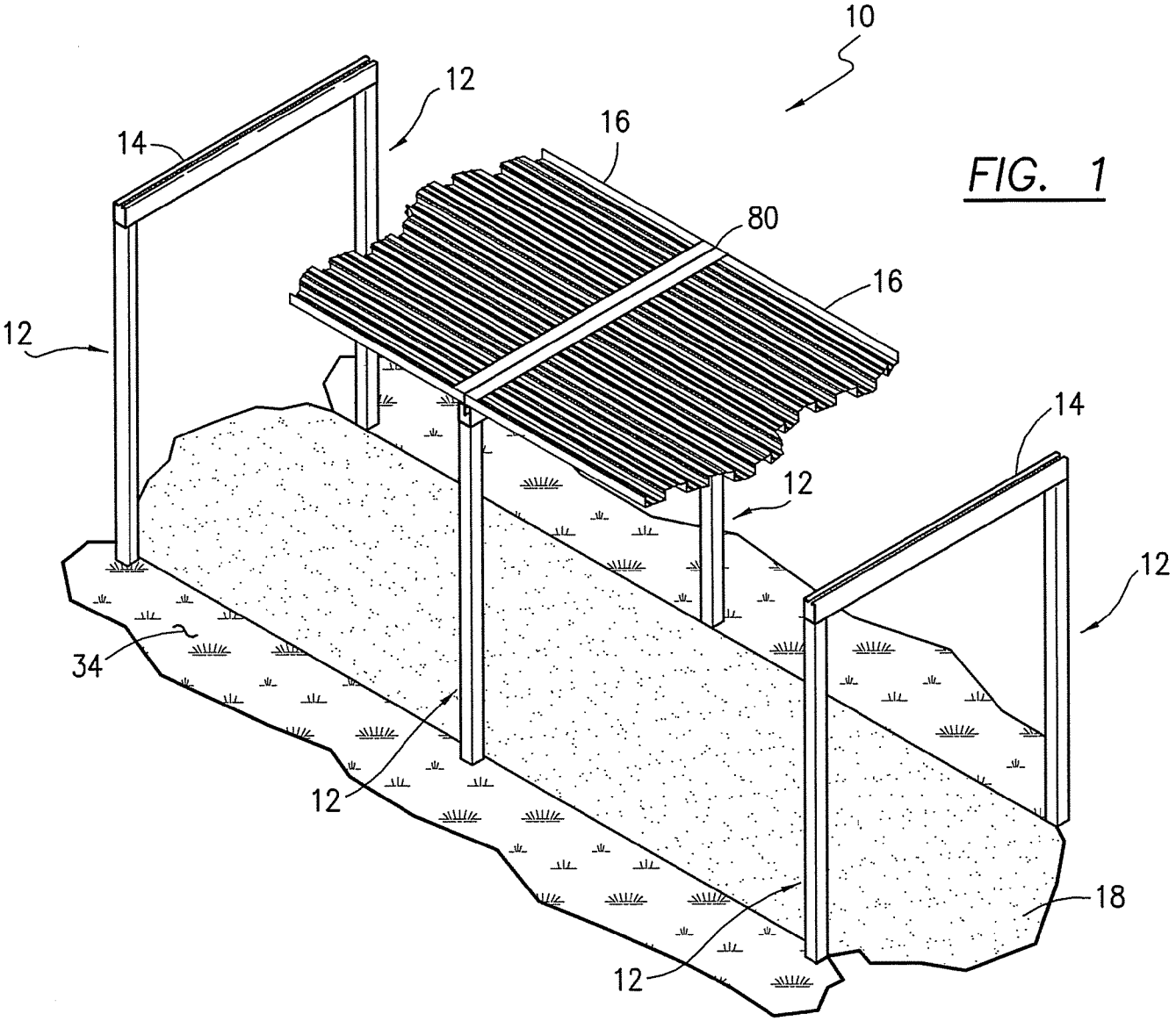
FIG. 1 is a perspective view of a portion of the canopy of this invention depicting part of two decking sections.
Figure 2:
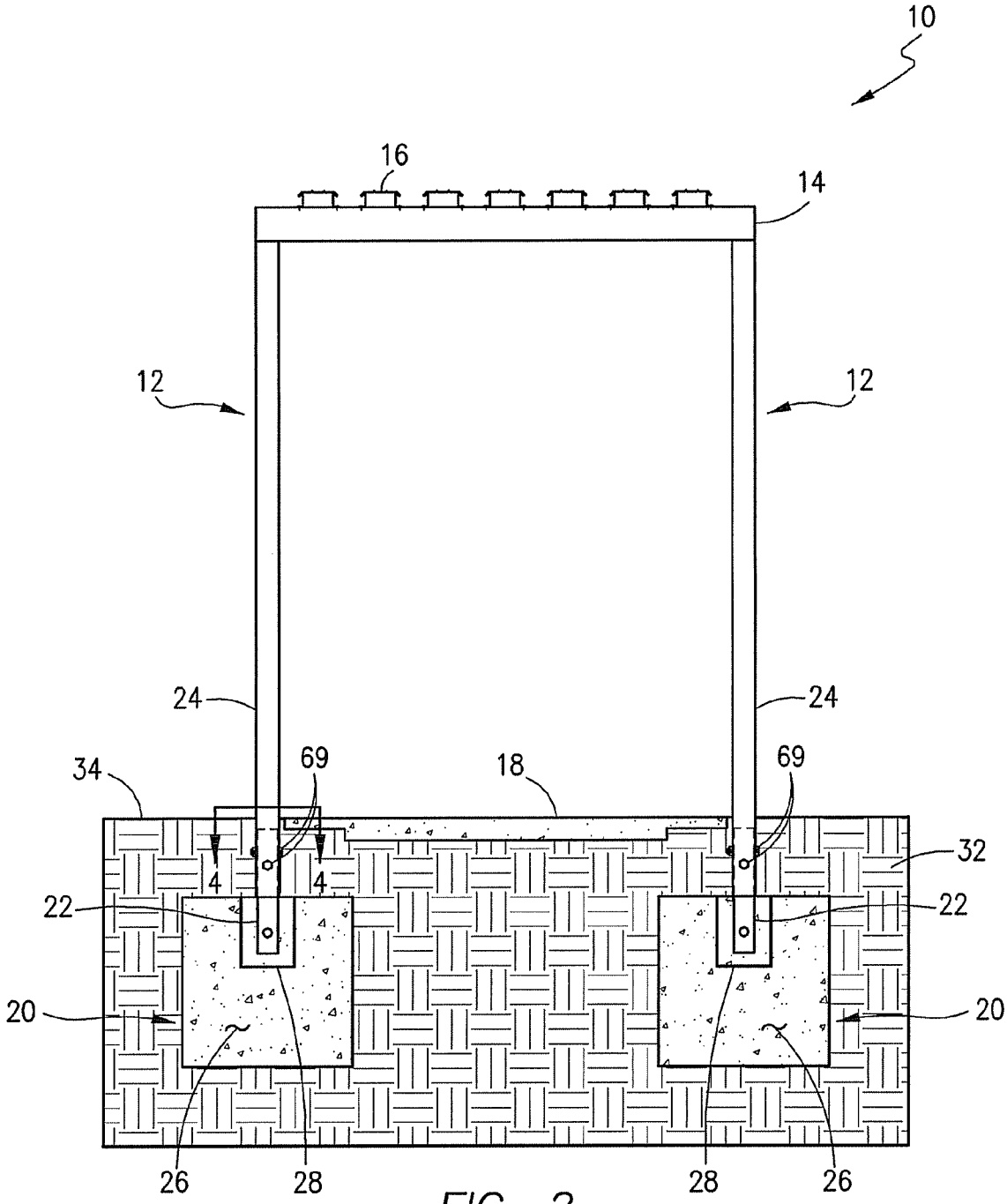
FIG. 2 is an end view, in partial cross section, illustrating a pair of vertical supports, a beam and a portion of a decking section.

Considering initially FIGS. 1 and 2, a canopy 10 in the form of a covered walkway comprises a number of vertical supports 12, a number of beams 14 and a number of decking sections 16. For purposes of illustration, the covered walkway 10 is shown with a cut-away portion of the decking sections 16 overlying a sidewalk 18. In this embodiment of the invention, the vertical supports 12 are arranged in pairs, one on either side of the sidewalk 18, and adjacent pairs of vertical supports 12 are spaced from one another in the longitudinal direction, e.g. the direction in which the sidewalk 18 extends. Each vertical support 12 comprises a footer 20, an insert tube 22 and a post 24. The footer 20 of each vertical support includes a body of concrete 26 which varies in dimension according to the length of the posts 24, the spacing between adjacent posts 24 and other engineering considerations. Typically, the body of concrete 26 is no less than 30 inches deep, 30 inches wide and 30 inches long, within which a blockout 28 is embedded. The blockout 28 receives the lower portion of the insert tube 22 and is filled with concrete flush with the top of the remainder of the concrete 26 forming the footer 20 to firmly and permanently secure the insert tube 22 within the footer 20. As shown in FIG. 3, an upper, exposed portion 30 of the insert tube 22 protrudes outwardly from the footer 20. Preferably, the insert tube 22 is approximately 24 inches in length, with about half of it embedded within the concrete filling the blockout 28 and the other half forming the exposed portion 30. The footer 20 is located within the ground 32 to a depth such that the top of the exposed portion 30 of the insert tube 22 remains below the level of the finish grade 34 of the ground 32, e.g. on the order of approximately 2-3 inches below such finish grade 34.

Referring now to FIG. 4, the insert tube 22 and post 24 of each vertical support 12 are shown in detail. Each insert tube 22 is preferably formed of aluminum in an extrusion operation with opposed side walls 36 and 38 and opposed end walls 40 and 42. The side walls 36, 38 and end walls 40, 42 are connected to one another by a transition area 44 at each corner of the insert tube 22, forming a hollow interior 46.

Each post 24 is generally square in shape having an outer wall 48 defined by opposed side sections 50 and 52 connected to opposed end sections 54 and 56 to form a hollow interior 58. Two screw bosses or cases 60 are located at each of the end sections 54 and 56 of the posts 24. In the presently preferred embodiment, the posts 24 are fabricated of aluminum in an extrusion operation with the screw cases 60 being integrally formed along the entire length of the end sections 54 and 56 of the posts 24. The screw cases 60 are spaced from one another along each end section 54 and 56, and are spaced from the side sections 50 and 52 forming a cavity 61 within the hollow interior 58 of the posts 24 at each corner. Each screw case 60 includes a first arm 62 and a second arm 64 with a bore 66 formed between them. The first and second arms 62, 64 gradually curve toward one another as depicted in FIG. 4, and their ends are separated by a space 68. The screw cases 60 greatly enhance the structural rigidity of the posts 24, thus allowing the posts to have a relatively thin wall thickness, e.g. on the order of 0.125 inches, without sacrificing strength or durability. Additionally, as discussed in detail below, the screw cases 60 mount the beams 14 without the need for welding.

As seen in FIG. 4, the insert tube 22 of each vertical support 12 is received within the hollow interior 58 of a post 24 such that the transition area 44 at each of the four corners of the insert tube 22 is captured within a cavity 61 at each corner of a post 24. The post 24 covers the entire exposed portion 30 of the insert tube 22 and rests against the top of the footer 20. Preferably, the post 24 are connected to the exposed portion 30 of an insert tube 22 with bolts, screws or other suitable removable fastener 69. See FIG. 2.

In the embodiment of the canopy 10 shown in FIGS. 1 and 2, each vertical support 12 within a pair, located on either side of the sidewalk 18, mounts one end of a beam 14. As discussed above, the practice of welding a bolt plate or angle employed in prior walkways resulted in a weakening of the beam and/or post. This problem is overcome in the present invention by the provision of the screw cases 60 in the posts 24. As shown in FIG. 5, a self-tapping screw 70 passes through the bottom wall 72 of a beam 14 and into the bore 66 of each screw case 60. When the screws 70 are tightened down, the beam 14 is securely mounted atop the post 24.

With the beams 14 in place on the vertical supports 12, the decking sections 16 may be added to complete the canopy 10. One decking section 16 extends in the longitudinal direction between two adjacent beams 14. Preferably, the decking sections 16 are mounted by screws, bolts or other removable fasteners 74 to the top wall 76 of the beams 14. For purposes of illustration, the joint formed by abutting decking sections 16 along the length of a beam 14 is shown covered by a rain cap 80 but the details of same form no part of this invention and are therefore not discussed herein.

In some installations, the canopy of this invention must be positioned along side of a building. With reference to FIG. 6, a canopy 90 is shown wherein only a single vertical support 12 is employed and the beam 14 is connected directly to the side 92 of a building 94, represented schematically in the drawing. A sidewalk 18 is shown in FIG. 6 for purposes of illustration, but it should be understood that the canopy 90 could cover any other area and function, for example, as a carport or storage area. Details of the construction of the canopy 90 are otherwise the same as in canopy 10 discussed above.

Still other applications do not permit the use of two vertical supports 12 mounted side-by-side as depicted in FIG. 1. A portion of a building or other obstruction may prevent the installation of one of the vertical supports 12 within a pair. As shown in FIG. 7, these types of situations call for a canopy 96 which comprises a single vertical support 12 and a brace 98 connected between the post 24 and beam 14 so that the beam 14 is cantilevered with respect to the vertical support 12. The brace 98 is preferably secured to both the post 24 and beam 14 with removable fasteners such as bolts (not shown). As in FIG. 6, a sidewalk 18 is shown in FIG. 7 for purposes of illustration but the canopy 96 could cover any other area. Details of the construction of the canopy 96 are otherwise the same as in canopies 10, and 90 discussed above.

Figure 9:
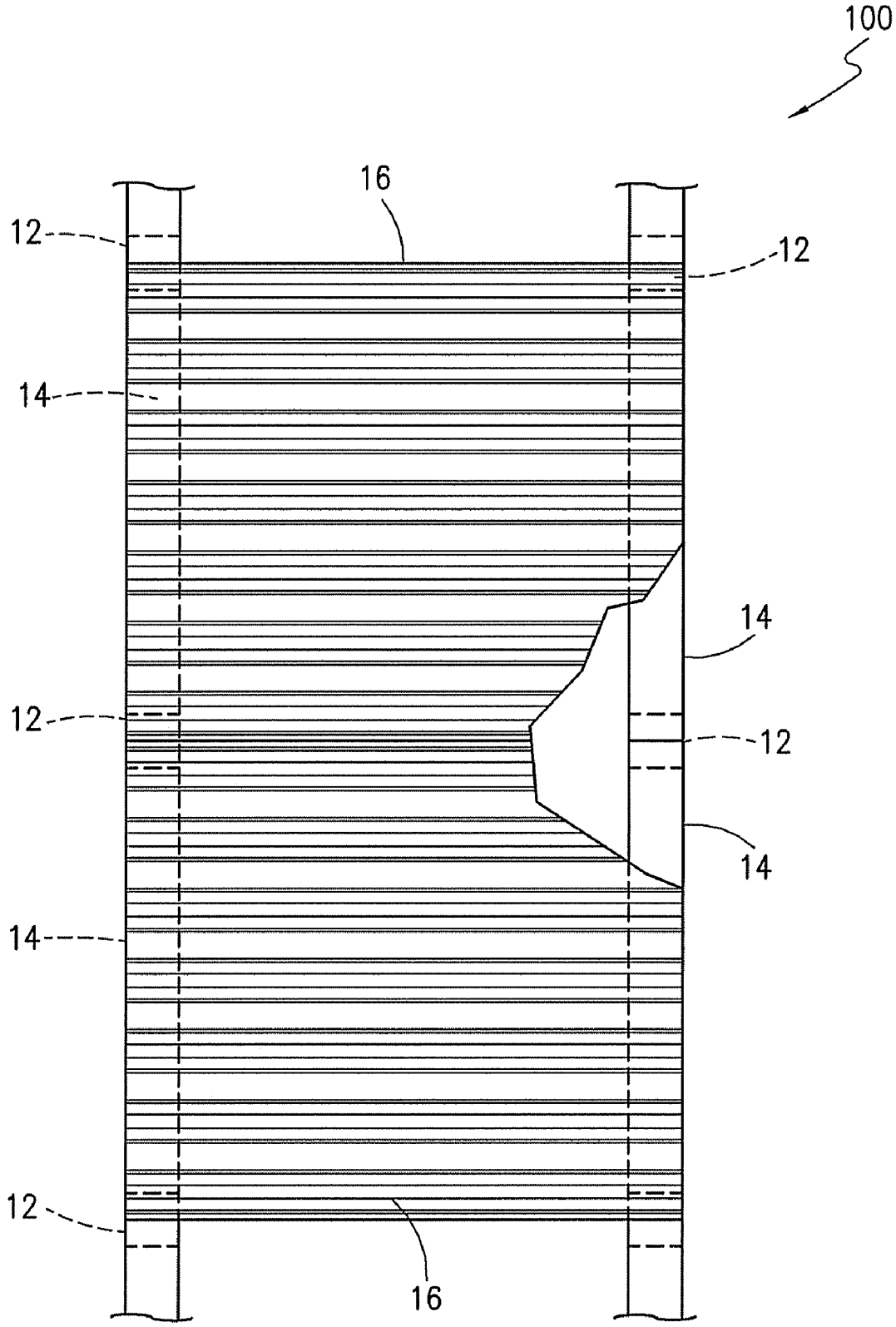
FIG. 9 is a schematic plan view of a canopy construction in which the beams and decking are arranged at 90° compared to FIG. 1.
Figure 10:
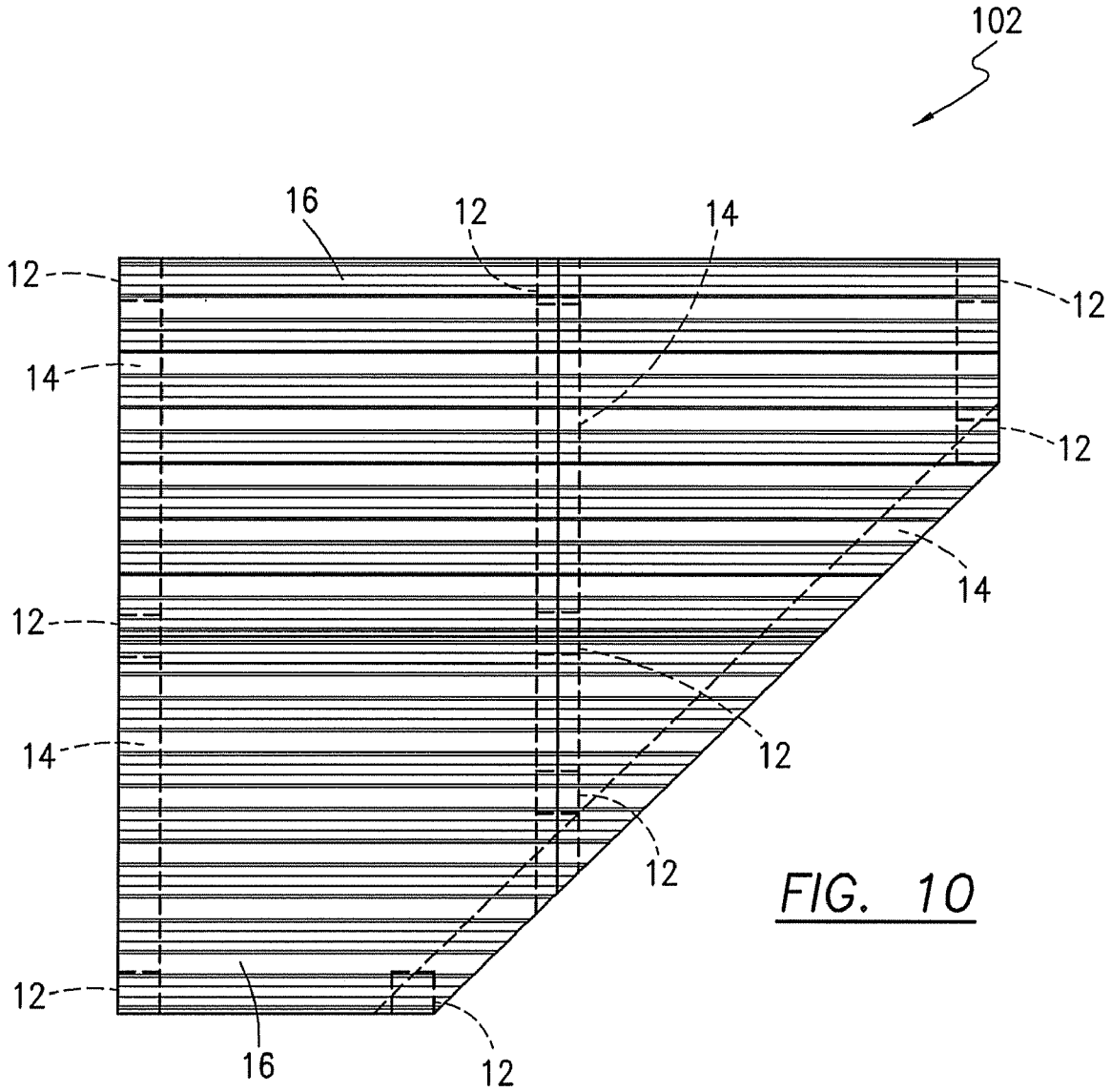
FIG. 10 is a schematic plan view of a canopy construction covering an area other than a sidewalk.

Referring now to FIGS. 9 and 10, schematic depictions are provided of alternative canopy constructions according to this invention. Except as described below, such canopies have the same detailed construction as those described above in connection with a discussion of FIGS. 1-7. In FIG. 9, a canopy 100 is illustrated which is similar to FIG. 1 but wherein the beams 14 extend in the longitudinal direction in between adjacent vertical supports 12, i.e. in the direction of the sidewalk 18 in FIG. 1, rather than in the transverse direction. Consequently, the decking 16 of FIG. 9 extends at an angle of 90° to the direction of the decking 16 in the canopy 10 of FIG. 1. The vertical supports 12 are depicted in phantom lines in FIG. 9, which is a plan view of the canopy 100. FIG. 10 is illustrative of a canopy 102 intended to demonstrate that an area of essentially any size and shape may be covered by the canopy construction of this invention. In this embodiment, the location of vertical supports 12 and beams 14, both shown in phantom lines in this plan view, are dictated by the shape of the area to be covered. The vertical supports 12 are not arranged in pairs and in some locations are staggered or offset from one another. Beams 14 connect to the vertical supports 12, in the same manner as discussed above, and decking 15 is affixed atop the beams 14.

The demountable, reusable canopies 10, 90, 96, 100 and 102 of this invention provide a number of advantages over prior designs. Only the insert tube 22 is permanently mounted to the footer 20 because there is a mechanical connection, e.g. bolts, screws or the like, between the insert tube 22 and post 24. As a result, the posts 24 may be easily removed from the insert tubes 22 to permit disassembly of the canopies. Because the insert tubes 22 are located below the finish grade 34 of the ground 32, they may be covered up with earth, level with the finish grade 34, and hidden from view when the canopies are disassembled. If it is ever desired to reassemble a canopy, the insert tubes 22 are uncovered allowing the assembly operation described above to proceed. In addition to the ease of assembly, disassembly and reassembly provided by the canopies of this invention, the screw cases 60 of the posts 24 add strength and durability because they eliminate the need for welded connections between the posts 24 and beams 16, as discussed above.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

For example, each of the vertical supports 12 for use with the canopies 10, 90, 96, 100 and 102 has been described as including an insert tube 22 and a post 24 with cross sections shown in FIG. 4. It is contemplated that an alternative construction of vertical supports 104 could be employed. As illustrated in FIG. 8, the insert tube 22 and post 24 of vertical supports 12 may be replaced by a lower post segment 106 and an upper post segment 108 joined together by an insert 110. In this embodiment, the lower post segment 106 is embedded within the footer 20 in the same manner as insert tube 22 and extends to a point below the finish grade 34 of the ground 32. The upper post segment 108 butts against the lower post segment 106 and these two elements are mounted to one another by the insert 110. As seen in FIG. 8, the insert 110 extends within the interior of both the lower and upper post segments 106, 108 and is connected to them by bolts 112. Other types of coupling elements besides the insert 110 may be employed to connect the two post segments 106 and 108 together, e.g. a collar (not shown) extending around the outside surfaces of both segments 106, 108 and spanning the butt joint between the two, and the insert 110 or other coupling element may be secured to the post segments 106, 108 by other suitable means instead of bolts 112.

Therefore, it is intended that the invention not be limited to the particular embodiment disclosed as the best mode contemplated for carrying out this invention, but that the invention will include all embodiments falling within the scope of the appended claims.

What is claimed is:

1. A canopy, comprising:

a number of vertical supports each comprising:

(i) an insert tube having opposed ends;

(ii) a footer located in the ground beneath finish grade, a first end of said insert tube being mounted to said footer, an exposed portion of said insert tube extending outwardly from said footer so that a second end of said insert tube is positioned below said finish grade of the ground;

(iii) a post having a first end, a second end and an outer wall defining a hollow interior, a number of screw cases being affixed to said outer wall within said hollow interior and extending between said first and second ends, said exposed portion of said insert tube being received within said hollow interior of said post and being mounted to said outer wall thereof;

a number of beams, each of said beams spanning a space between two of said vertical supports and being mounted to said posts via said screw cases; and a number of decking sections, each of said decking sections extending between and mounted to adjacent beams.

2. The canopy of claim 1 in which said insert tube of each of said vertical supports includes opposed side walls and opposed end walls, said opposed side walls being connected to said opposed end walls by a transition section.

3. The canopy of claim 2 in which said post of each of said vertical supports includes an outer wall comprising opposed side sections connected to opposed end sections, a first pair of said screw cases being mounted to one of said end sections and a second pair of said screw cases being mounted to the outer of said end sections.

4. The canopy of claim 3 in which a cavity is formed between each of said screw cases and one of said side sections of said post, each of said transition sections of said insert tube being received within one of said cavities.

5. The canopy of claim 3 in which each of said screw cases comprises a first arm and a second arm, each of said first and second aims extending from said outer wall of said post and having an end, said end of said first arm being spaced from said end of said second arm, a bore being formed between said first and second arms.

6. The canopy of claim 5 in which self-tapping screws extend through said beam and into each of said bores in said screw cases to secure said beams to said vertical supports.

7. The canopy of claim 3 in which said screw cases provide structural rigidity to said outer wall of said post.

8. The canopy of claim 1 in which said post is mounted to said exposed portion of said insert tube by at least one bolt and nut.

9. The canopy of claim 1 in which said decking sections may be disassembled from said beams, said beams may be disassembled from said vertical supports and said vertical supports may be disassembled from said insert tubes, said insert tubes remaining in the ground with said second end thereof located below said finish grade.

10. The walkway of claim 9 in which said exposed portion of said insert tube may be uncovered after disassembly from said post, by removal of ground overlying said insert tube, and then re-assembled to said post.

11. The canopy of claim 1 in which said vertical supports are arranged in pairs in a longitudinal direction along an area to be covered and said vertical supports in each pair are spaced from one another in a transverse direction generally perpendicular to said longitudinal direction.

12. The canopy of claim 11 in which each of said beams spans said space between one pair of said vertical supports.

13. A canopy extending in a longitudinal direction along an area to be covered, comprising:

a number of vertical supports arranged in pairs in said longitudinal direction, said vertical supports in each pair being spaced from one another in a transverse direction generally perpendicular to said longitudinal direction, each of said vertical supports comprising:

(i) an insert tube having opposed ends;

(ii) a footer located in the ground beneath finish grade, a first end of said insert tube being mounted to said footer, an exposed portion of said insert tube extending outwardly from said footer so that a second end of said insert tube is positioned below said finish grade of the ground;

(iii) a post having a first end, a second end and an outer wall defining a hollow interior, a number of screw cases being affixed to said outer wall within said hollow interior and extending between said first and second ends, said exposed portion of said insert tube being received within said hollow interior of said post and being mounted to said outer wall thereof;

a number of beams, each of said beams spanning said space between one pair of said vertical supports, one of said beams being mounted to said post of each pair of vertical supports via said screw cases; and a number of decking sections, each of said decking sections extending between and mounted to adjacent beams.

14. A canopy extending in a longitudinal direction along an area to be covered, comprising:

a number of vertical supports spaced from one another in said longitudinal direction, each of said vertical supports comprising:

(i) an insert tube having opposed ends;

(ii) a footer located in the ground beneath finish grade, a first end of said insert tube being mounted to said footer, an exposed portion of said insert tube extending outwardly from said footer so that a second end of said insert tube is positioned below said finish grade of the ground;

(iii) a post having a first end, a second end and an outer wall defining a hollow interior, a number of screw eases being affixed to said outer wall within said hollow interior and extending between said first and second ends, said exposed portion of said insert tube being received within said hollow interior of said post and being mounted to said outer wall thereof;

a number of beams, each of said beams being mounted to said post of one of said vertical supports via said screw eases and being adapted to mount to the side of a fixed structure; and a number of decking sections, each of said decking sections extending between and mounted to adjacent beams.

15. A canopy extending in a longitudinal direction along an area to be covered, comprising:

a number of vertical supports spaced from one another in said longitudinal direction, each of said vertical supports comprising:

(i) an insert tube having opposed ends;

(ii) a footer located in the ground beneath finish grade, a first end of said insert tube being mounted to said footer, an exposed portion of said insert tube extending outwardly from said footer so that a second end of said insert tube is positioned below said finish grade of the ground;

(iii) a post having a first end, a second end and an outer wall defining a hollow interior, a number of screw cases being affixed to said outer wall within said hollow interior and extending between said first and second ends, said exposed portion of said insert tube being received within said hollow interior of said post and being mounted to said outer wall thereof;

a number of beams, each of said beams being mounted at one end to said post of one of said vertical supports via said screw cases so that each beam is cantilevered relative to one of said posts;

a number of braces, each of said braces being connected between one of said posts and one of said beams to support said beams in said cantilevered position; and a number of decking sections, each of said decking sections extending between and mounted to adjacent beams.

16. A canopy, comprising:

a number of vertical supports each comprising:

(i) a first post segment;

(ii) a footer located in the ground beneath finish grade, a first end of said first post segment being mounted to said footer, an exposed portion of said first post segment extending outwardly from said footer so that a second end of said first post segment is positioned below said finish grade of the ground;

(iii) a second post segment having a first end and a second end which abuts said second end of said first post segment;

(iv) a coupling element extending between said first and second post segments to connect them together;

a number of beams, at least one end of each of said beams being mounted to one of said posts; and a number of decking sections, each of said decking sections extending between and mounting to adjacent beams.

17. The canopy of claim 16 in which said coupling element is an insert extending within the interior of said first post segment and the interior of said second post segment, said insert being mounted to each of said first and second post segments.

18. A method of constructing a canopy extending in a longitudinal direction along an area to be covered, comprising:

(a) locating a number of longitudinally spaced pairs of footers in the ground along said area to be covered, said footers in each pair being spaced in a transverse direction from one another generally perpendicular to said longitudinal direction;

(b) mounting an insert tube within each of said footers so that an exposed portion of said insert tube extends to a point below the finish grade of the ground;

(c) inserting said exposed portion of each of said insert tubes into the hollow interior of a post and mounting said insert tubes to said posts, each of said posts having a number of screw cases within said hollow interior which extend between the ends of said post;

(d) mounting a beam to each of said posts associated with one of said pairs of footers by inserting fasteners through said beam and into engagement with each of said screw cases; and (e) mounting a decking section to adjacent beams.

19. The method of claim 18 in which step (c) comprises:

(i) providing said insert tube with opposed side walls connected by a transition section to opposed end walls;

(ii) providing said post with a cavity located between each of said screw cases and an outer wall of said post; and (iii) inserting each transition seetion of said insert tubes into one of said cavities of said post.

20. The method of claim 18 in which step (d) comprises passing a self-tapping screw through said beams and into a bore formed in said screw case of said post.

21. The method of claim 18 further comprising:

(f) providing for the disassembly of said canopy by sequentially reversing the operations recited in steps (c), (d) and (e) while maintaining said insert tubes and said footers in place with said exposed portion of said insert tubes remaining below the finish grade of the ground.

22. The method of claim 21 further comprising:

(g) providing for the re-assembly of said canopy by uncovering said exposed portion of said insert tubes from the ground, and then repeating the operations recited in steps (c), (d) and (e).

23. A method of constructing a canopy extending in a longitudinal direction along an area to be covered, comprising:

(a) locating a number of longitudinally spaced footers in the ground along said area to be covered;

(b) mounting an insert tube within each of said footers so that an exposed portion of said insert tube extends to a point below the finish grade of the ground;

(c) inserting said exposed portion of each of said insert tubes into the hollow interior of a post and mounting said insert tubes to said posts, each of said posts having a number of screw cases within said hollow interior which extend between the ends of said post;

(d) mounting a first end of a beam to each of said posts by inserting fasteners through said beam and into engagement with each of said screw cases;

(e) mounting a second end of said beam to a fixed structure; and (f) mounting a decking section to adjacent beams.

24. A method of constructing a canopy extending in a longitudinal direction along an area to be covered, comprising:

(a) locating a number of longitudinally spaced footers in the ground along said area to be covered;

(b) mounting an insert tube within each of said footers so that an exposed portion of said insert tube extends to a point below the finish grade of the ground;

(c) inserting said exposed portion of each of said insert tubes into the hollow interior of a post and mounting said insert tubes to said posts, each of said posts having a number of screw cases within said hollow interior which extend between the ends of said post;

(d) mounting one end of a beam to each of said posts by inserting fasteners through said beam and into engagement with each of said screw eases so that each beam is cantilevered relative to one of said posts;

(e) mounting a brace between one of said posts and one of said beams to support said beams in said cantilevered position; and (t) mounting a decking section to adjacent beams.

25. A method of constructing a canopy, comprising:

(a) locating a number of footers in the ground along said area to be covered;

(b) mounting an insert tube within each of said footers so that an exposed portion of said insert tube extends to a point below the finish grade of the ground;

(c) inserting said exposed portion of each of said insert tubes into the hollow interior of a post and mounting said insert tubes to said posts;

(d) providing a number of beams;

(e) mounting one end of at least one beam to each of said posts; and (t) mounting a decking section to adjacent beams.

26. The method of claim 25 in which step (c) comprises:

(i) providing said posts with a number of screw cases within said hollow interior thereof which extend between said ends of said posts;

(ii) providing said insert tube with opposed side walls connected by a transition section to opposed end walls;

(iii) providing said post with a cavity located between each of said screw cases and an outer wall of said post; and (iv) inserting each transition section of said insert tubes into one of said cavities of said post.

27. The method of claim 25 in which step (e) comprises passing a self-tapping screw through said beams and into a bore formed in said screw case of said post.

28. The method of claim 25 further comprising:

(g) providing for the disassembly of said canopy by sequentially reversing the operations recited in steps (c), (e) and (f) while maintaining said insert tubes and said footers in place with said exposed portion of said insert tubes remaining below the finish grade of the ground.

29. The method of claim 28 further comprising:

(h) providing for the re-assembly of said canopy by uncovering said exposed portion of said insert tubes from the ground, and then repeating the operations recited in steps (c), (e) and (f).

* * * * *